United States Patent [19]

Petrofsky et al.

[11] Patent Number: 4,570,927

[45] Date of Patent: Feb. 18, 1986

[54] THERAPEUTIC DEVICE

[75] Inventors: Jerrold S. Petrofsky, Beavercreek; Chandler A. Phillips, Tipp City; Harry H. Heaton, III, Beavercreek, all of Ohio

[73] Assignee: Wright State University, Dayton, Ohio

[21] Appl. No.: 561,769

[22] Filed: Dec. 15, 1983

[51] Int. Cl.[4] ..... A63B 21/00; A61H 1/02

[52] U.S. Cl. ..... 272/73; 272/DIG. 6; 128/25 R

[58] Field of Search ..... 272/73, DIG. 6, 129; 128/25 B, 32, 33, 25 R, 779, 782; 73/492, 493, 379

[56] References Cited

U.S. PATENT DOCUMENTS

| | | | |
|---|---|---|---|
| 2,273,088 | 2/1942 | Byers | 128/25 R |
| 3,713,438 | 1/1973 | Knutsen | 128/25 R |
| 3,717,857 | 2/1973 | Evans | 128/782 |
| 4,258,706 | 3/1981 | Shank | 128/33 |
| 4,370,602 | 1/1983 | Jones, Jr. et al. | 128/33 |
| 4,480,830 | 11/1984 | Petrofsky et al. | 272/DIG. 6 |

FOREIGN PATENT DOCUMENTS

| | | | |
|---|---|---|---|
| 584842 | 12/1977 | U.S.S.R. | 128/779 |

*Primary Examiner*—Richard J. Apley
*Assistant Examiner*—S. R. Crow
*Attorney, Agent, or Firm*—Biebel, French & Nauman

[57] ABSTRACT

A therapeutic device for reversing osteoporosis in human limbs which comprises a crank assembly adapted to attach to the distal ends of a pair of human limbs such as the legs, a motor for rotating the crank assembly so that the limbs move along a predetermined path, a vibrator for vibrating the crank assembly, thereby transmitting vibrations to the limbs, and a control for regulating the amplitude of the vibrations transmitted to the limbs. In a preferred embodiment, the control includes an accelerometer adapted to be mounted on a supported limb to generate a signal proportional to the amplitude of the vibrations actually felt by the limbs. The signal is used to modify the amplitude of electric current generated by the control to power the vibrator such that the amplitude of driving vibrations generated by the vibrator is proportional to the amplitude of vibrations felt by the limbs so that the amount of vibration of the limbs is maintained within a predetermined range.

13 Claims, 5 Drawing Figures

THERAPEUTIC DEVICE

BACKGROUND OF THE INVENTION

The present invention relates to therapeutic devices and, more particularly, to therapeutic devices for exercising immobilized limbs in order to reverse the effects of osteoporosis.

When human limbs are immobilized for prolonged periods of time, whether due to paralysis or to encasement in a cast, a condition known as osteoporosis can occur. Osteoporosis is a deossification with absolute decrease in bone tissue resulting in, among other things, structural weakness of the bone. Many therapies have been developed to slow down or reverse osteoporosis. For example, since it is well-known that human bones are sensitive to electric current, attempts have been made to utilize electric current to promote osteogenesis, or formation of bone.

Although osteogenesis can be stimulated by delivering electric current to bones by means of internal electrodes, there are disadvantages to this type of treatment. One disadvantage is that stimulation of bones by electric current has only a slight effect on increasing bone formation.

More recently, it has been found that the vibration of bones can reverse osteoporosis. This relationship has been found in bones which have been made osteoporatic by previous plaster cast immobilization, such as that used to treat a fracture of the leg bone. It is believed that the application of mechanical vibration to the limbs deforms the bones within the limbs and generates an endogenous electric current due to the piezoelectric effect of the bone matrix. Osteoporatic bones in the legs have been treated by the application of mechanical vibrations to the soles of the feet. A disadvantage with this type of treatment is that the transmission of vibrations through the bones of the legs tends to vibrate and hence build up the bones in a single plane or along one axis, to the exclusion of other bones or along other axes.

In a specific example, vibration applied to the lower leg vibrated the knee at a single angle and missed stressing many critical bone surfaces along the leg. Of course, the application of vibrations to the leg or other limb at a plurality of locations may counteract this disdvantage to some extent, but this would greatly lengthen the time and expense of the treatment.

Another problem encountered with this type of therapeutic treatment is that it is difficult to determine the magnitude of the vibrations actually felt by the bones of the legs receiving the vibrations. For example, if the mechanical vibration is applied to the bottom of the foot, the soft tissue in that area and in the knee absorb some of the vibration, so that it is not possible to determine the amplitude of vibration actually felt by the bone simply by measuring the amplitude of the vibration applied to the limb. This relationship between the applied vibration and the vibration actually felt by the bones renders conventional vibrators unacceptable for use in giving reproducible results in terms of knee and leg treatment.

Accordingly, there is a need for a therapeutic device which applies external mechanical vibrations to the limbs of a subject and thereby vibrates the bones of those limbs sufficiently to reverse the effects of osteoporosis. Furthermore, such a device should be designed to vibrate the bones of the subject's limbs in a number of planes so that all of the bone surfaces are vibrated sufficiently to reverse the effects of osteoporosis. In addition, the device should include means for detecting the resultant vibration of the bones of the subject's limbs so that the magnitude of the vibrations actually felt by the bones can be controlled.

SUMMARY OF THE INVENTION

The present invention was developed to provide a device for the vibration stimulation of the bones of immobilized limbs to reverse osteoporosis, in which the limbs are vibrated while in motion, so that the bones are built up in a plurality of planes and along a plurality of axes. Use of the invention not only reduces the treatment time required, but effects a more thorough reversal of osteoporosis than prior methods and devices. The present invention is a therapeutic device which comprises a crank assembly adapted to be attached to the distal ends of a pair of human limbs, such as the legs, a drive motor which is attached to the crank assembly to rotate the crank assembly so that the legs move in a circular pattern similar to pedaling a bicycle, a vibrator for vibrating the crank assembly while the legs are moving, and a control for generating power to regulate the magnitude of the driving vibrations generated by the vibrator. The pedal assembly, drive motor and vibrator are all mounted on a single frame which increases the stability and portability of the device.

In a preferred embodiment, the device includes an accelerometer which is adapted to be attached to one of the supported limbs of the human subject, preferably on a bone surface, so that it measures the active amplitude of the vibrations felt by the bones of the limbs attached to the device. The accelerometer generates a signal, proportional to the amplitude of these measured vibrations, and the signal is used to vary the magnitude of the electric current generated by the control to drive the vibrator, thereby forming a closed-loop system which regulates the amplitude of the driving vibrations. The control is adjusted such that the maximum amplitude of the vibrations felt by the bones of the subject stays within a predetermined range throughout the use of the device by the subject. The vibrations felt by the bones are sufficiently strong to reverse osteoporosis, but are below the level at which pathological damage is caused.

It should be understood that this device can be adapted relatively easily to perform the same therapeutic treatment upon the arms of a human subject, but this specification will discuss the invention in relation to treatment of the legs. To operate the device, the feet of the subject, are strapped to the crank assembly, and the motor is actuated to rotate the crank, thereby moving the feet in a circular pattern similar to a bicycle pedaling motion. While the legs are moving in this circular pattern, the vibrator generates vibrations which are transmitted to the crank assembly and through the assembly to the feet and legs of the subject. By rotating the legs in this circular pattern during the application of the vibrations, the bones of the legs, especially those in the vicinity of the knees, are vibrated in a variety of positions to ensure that all surfaces of the bones are adequately vibrated.

Accordingly, it is an object of the present invention to provide a therapeutic device for reversing osteoporosis in human limbs; a device in which the bones of the subject's limbs are vibrated by the application of external mechanical force while in motion to ensure that the bones are evenly vibrated; a device in which the amplitude of the vibrations felt by the subject's bones is measured and is used to control the driving vibrations applied to the limbs to maintain the effective amplitude below a predetermined maximum; and a device which vibrates the bones of the subject's limbs that is compact, portable and relatively inexpensive to manufacture, thereby making the device available to patients on a wide scale.

Other objects and advantages of the invention will be apparent from the following description, the accompanying drawings and the appended claims.

DETAILED DESCRIPTION OF THE PREFERRED EMBODIMENTS

Figure 1:
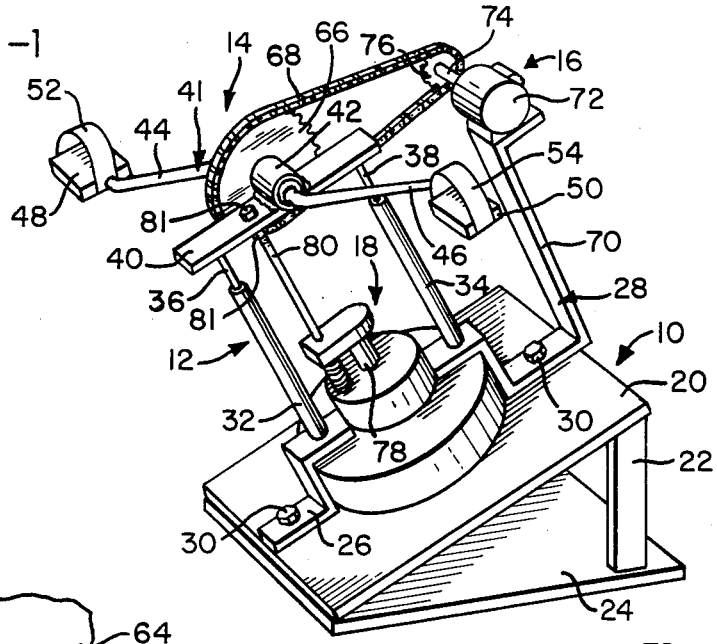
FIG. 1 is a somewhat schematic, perspective view of a therapeutic device comprising a preferred embodiment of the invention.
Figure 2:
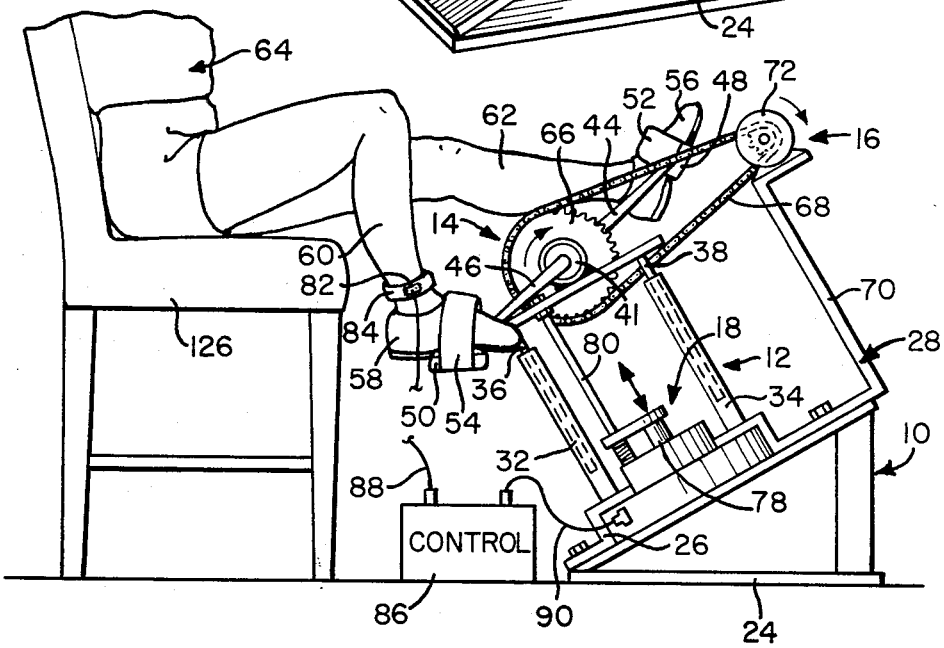
FIG. 2 is a side elevation of the embodiment of FIG. 1, showing its use with a human subject.

As shown in FIGS. 1 and 2, the therapeutic device of the present invention includes a base 10, a frame 12 mounted on the base, a crank assembly 14 supported by the frame, a drive motor assembly 16 and a vibrator 18. The base 10 includes a base plate 20 which is supported at an angle to the horizontal by struts 22 (one of which is shown). Struts 22 elevate an upper end of the base plate 20 from a foundation plate 24. Although not shown, it is within the scope of the invention to provide a base plate 20 which can be adjusted relative to the foundation plate 24 to provide a variety of angles of inclination to the horizontal to suit a particular human subject.

The vibrator 18 preferably is a standard electromagnetic-coupled vibrator that requires an input on the order of about 12 volts to operate. An example of such a vibrator is the Model C31-1 vibrator manufactured by MB Manufacturing Co., Inc. of New Haven, Conn. The vibrator 18 is mounted on the base plate 20 by brackets 26, 28, which are attached to the base plate by machine screws 30.

The frame 12 includes a pair of tubes 32, 34 which are attached to the brackets 26, 28, preferably by welding, and extend upwardly from the plane of the base plate 20. A pair of rods 36, 38 are shaped to telescope within the tubes 32, 34, respectively, and are attached to the underside of a support plate 40.

The crank assembly 14 is similar in construction to the crank assembly of a conventional bicycle, and includes a bearing housing 42 which is welded to an upper surface of the support plate 40, and a crank 41, rotatably attached to the housing and including crank arms 44, 46 extending outwardly from the bearing housing, and pedals 48, 50 rotatably attached to the ends of the crank arms 44, 46, respectively. The pedals 48, 50 have straps 52, 54, which preferably are adjustable and include closures of the hook-and-loop type, to secure the feet 56, 58 of the legs 60, 62 of a human subject 64 to the pedals.

It is within the scope of the invention to provide straps (not shown) which are adapted to receive the hands of a human subject. The function of the straps in either case is to secure the distal ends of the limbs it is desired to treat, so that the limbs remain engaged with the pedals even though the human subject 64 has lost control of the limbs due to a trauma, disease, or congenital defect. The crank assembly 14 includes a driven sprocket 66 which engages an endless sprocket chain 68 that is attached to the motor assembly 16.

Bracket 28 includes an upper arm 70 that supports a variable speed electric motor 72 comprising the motor assembly 16. The output shaft 74 of the motor 72 is attached to a drive sprocket 76 which engages the sprocket chain 68. Rotational movement of the drive sprocket 76 is transmitted by the sprocket chain 68 to the driven sprocket 66 to rotate the crank arms 44, 46 and pedals 48, 50 in a circular path.

The output shaft 78 of the vibrator 18 is connected by a rigid rod 80 to the support plate 40. The rod 80 is screwed to the plate 40 by nuts 81 which are threaded on an upper end of the rod above and below the plate. Vibration of the output shaft 78 is thereby transmitted through the rod 80 to the support plate 40 and to the crank assembly 14.

An accelerometer 82 is mounted on a strap 84 that is adapted to be fastened on the leg 60 of the subject 64. The strap 84 preferably includes a hook-and-loop type fastener so that it may be easily attached and removed from the leg 60. It is also preferable to attach the accelerometer 82 to the leg 60 near or over a bony protrusion such as the ankle bone so there is a minimum amount of skin between the accelerometer and the bone. The accelerometer 82 is connected to a control 86 by a wire 88, and the control is connected to the vibrator 18 by wire 90.

Due to energy losses and the inherent attenuation qualities of human skin, the amplitude felt by the bones may be less than the magnitude of the vibrations measured at, for example, the crank 41. Furthermore, the amplitude felt will vary with the change in angular relation between the legs 60, 62 and the crank 41 as the crank is pedaled. By mounting the accelerometer 82 on the leg 60, the amplitude of the vibrations actually felt by the bones at all times is measured.

Figure 3:
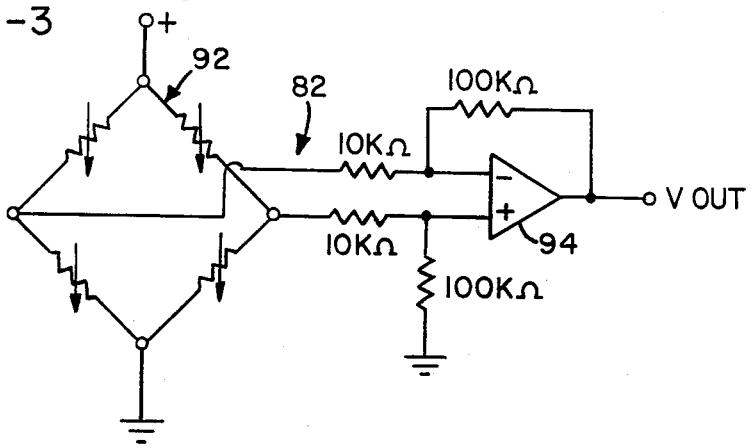
FIG. 3 is a schematic diagram showing an accelerometer circuit for the accelerometer shown in FIG. 2.

The accelerometer 82 is of a type well-known in the art and is shown schematically in FIG. 3. An appropriate accelerometer is the Model 7264-2000 manufactured by Endevco Corp. of San Juan Capistrano, Calif. The accelerometer circuit includes a bridge circuit, generally designated 92, which is connected to an operational amplifier 94 to produce a voltage that varies with the amount of acceleration applied to the accelerometer. The output of the accelerometer 82 is conducted to the control 86 through wire 88 to a vibrator feedback control circuit shown in FIG. 4.

The accelerometer output is amplified by operational amplifiers 96, 98 and halfwave rectified by diode 100 in combination with resistor 102 and capacitor 104. The signal passes through an inverting buffer 106 which consists of an operational amplifier 108 and an offset voltage input 110. The offset voltage input 110 is adjusted so that at zero acceleration, in which there is no signal from accelerometer 82, a predetermined maximum voltage is generated by the buffer 106, and at a maximum acceleration, zero voltage passes through the inverting buffer. The signal is then passed through a second buffer 112 which includes a transistor 114 and a variable resistor 116, the combination acting as an impedance shifter.

Figure 5:
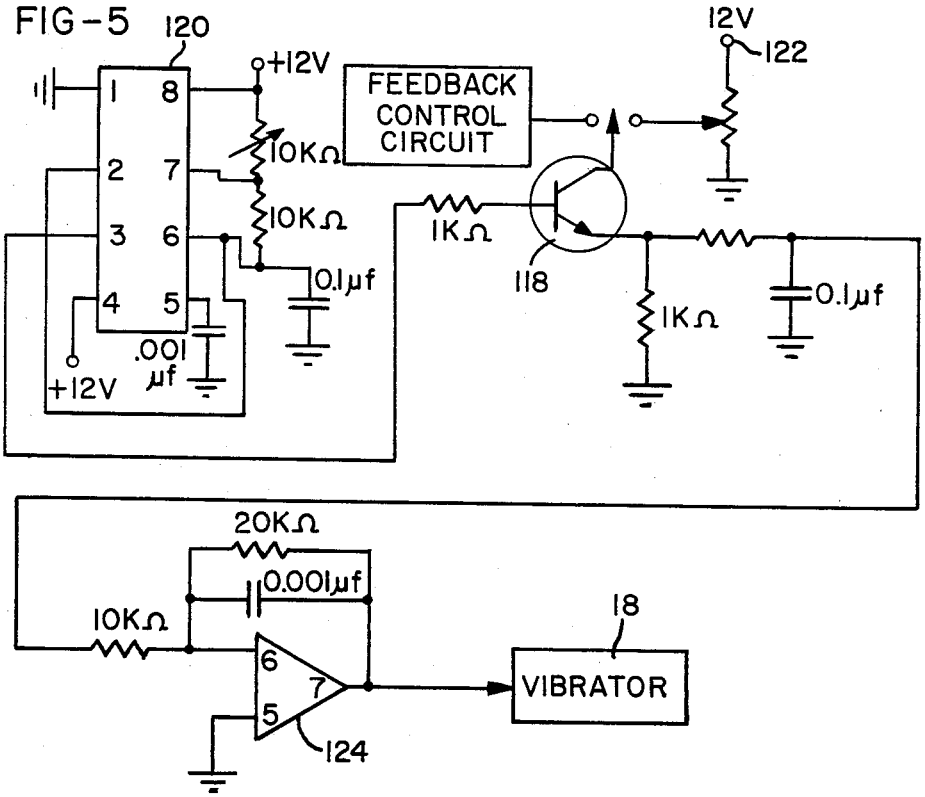
FIG. 5 is a schematic diagram showing the vibrator controller circuit of the embodiment shown in FIG. 2.

The output of the vibrator feedback control circuit is connected to the collector of a transistor 118 in a vibrator power circuit shown in FIG. 5. The vibrator power circuit includes a timer 120 which generates a square wave at a predetermined frequency. Experimentation has shown that a preferred frequency is between 10 and 40 hz. Frequencies much lower than 10 hz can create a resonant vibration in the knee, which has a natural frequency of about 6 hz, that would seriously damage the bones of the knee. Vibrations having a frequency higher than 40 hz have been found to cause pathological damage to the knee.

The square wave generated by timer 120 enters the base of the transistor 118. An alternate power source for the collector of transistor 118 is a 12 volt source 122 which can be varied to provide a constant voltage input. The square wave is then shaped to form a sine wave by a wave shaping component which includes an operational amplifier 124 connected as an integrator. The output of amplifier 124 is connected directly to the vibrator 18 by wire 90 (FIG. 2).

To operate the therapeutic device shown in FIGS. 1 and 2, the subject 64 is seated in a chair 126 of suitable height and the feet 56, 58 of the subject are strapped to the pedals 48, 50 of the crank assembly 14. The accelerometer 82 is strapped to the ankle of the leg 60 of the subject 64 at an appropriate location near a bone. The control 86 is actuated to power the vibrator 18 which transmits driving vibrations through the frame 12 and crank assembly 14 to the legs 60, 62 of the subject 64. The amplitude of the vibrations actually felt by the bones of the subject 64 is measured by the accelerometer 82, and a signal is generated which is used as an input in the feedback control circuit of FIG. 4. The output voltage at the buffer 112 is adjusted by adjusting the potentiometer 116 and/or voltage offset 110 to provide a predetermined voltage value for zero acceleration and a zero voltage output for a maximum desired acceleration. It has been found that a maximum vibration amplitude of between 10 g and 50 g, felt by the bones, is preferable.

The motor 16 is actuated to rotate the crank assembly 14, thereby causing the legs 60, 62 of the subject 64 to travel in a circular path simulating the riding of a bicycle. Since the angles at which the vibrations are transmitted to the legs vary as the legs move in the circular path, the amplitude of the driving vibration must constantly change to maintain the amplitude of the vibrations felt by the bones within the aforementioned range.

Figure 4:
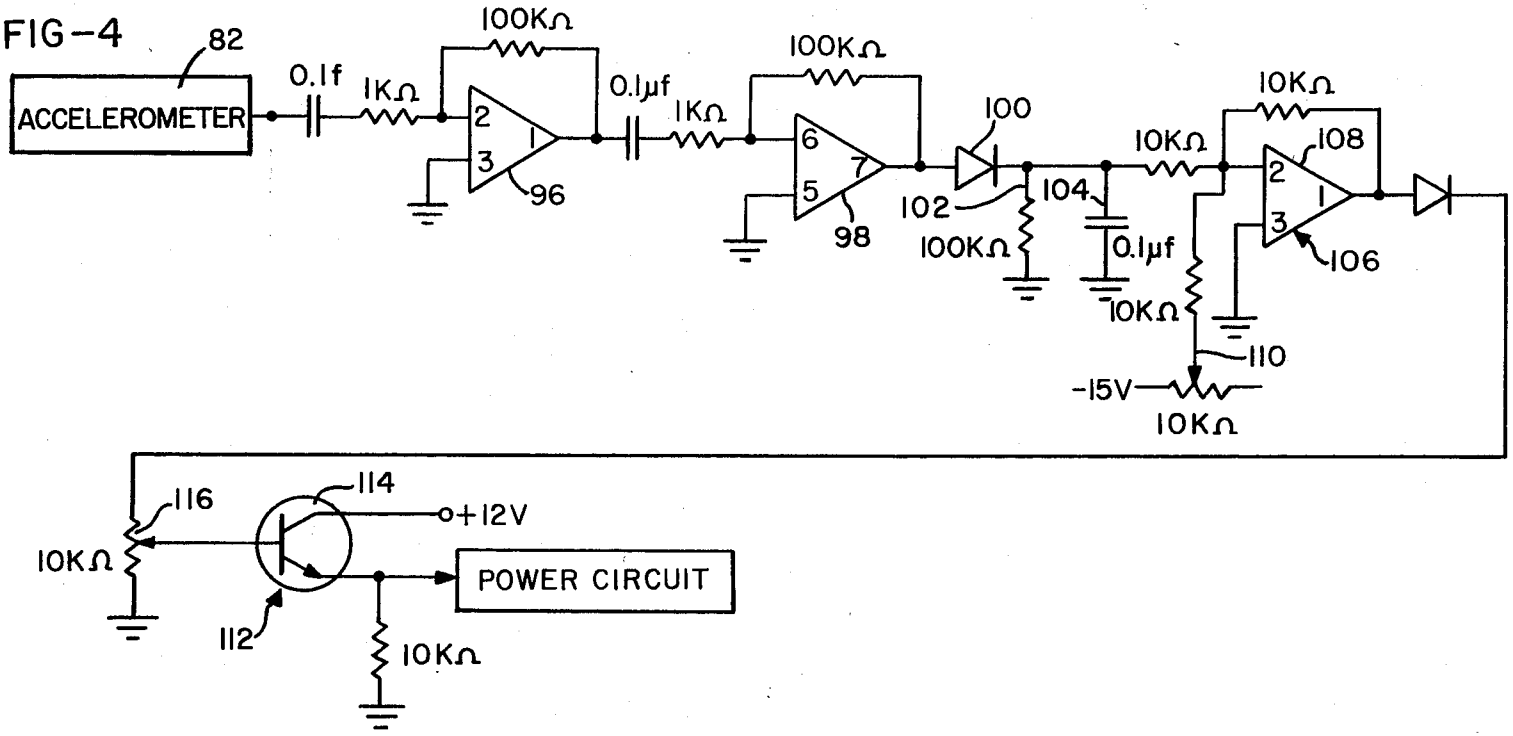
FIG. 4 is a schematic diagram showing the vibrator feedback control of the embodiment shown in FIG. 2.

Accordingly, as the amplitude of the felt vibrations reaches the maximum value, the voltage generated by the feedback circuit drops to zero thereby decreasing the amplitude of the signal from the controller circuit of FIG. 4 to the vibrator 18, although the frequency of the square wave generated by the timer 120 remains constant. This acts to reduce the amplitude of the driving vibration transmitted by the vibrator to the frame 12 and crank assembly 14 and to the legs 60, 62.

Conversely, should the amplitude of the vibrations felt by the accelerometer 82 drop below a predetermined value, the voltage generated by the feedback control circuit shown in FIG. 4 increases to a maximum value, effecting an increase in the amplitude of the current driving the vibrator 18. As a result, the amplitude of the driving vibrations transmitted to the legs 60, 62 of the subject 64 remain substantially constant as the legs are moved in circular paths by the crank assembly 14, even though the angles at which the vibrations are transmitted from the crank assembly to the legs change constantly. Vibrations of the appropriate amplitude and frequency are, therefore, transmitted to the legs 60, 62 of the subject 64 throughout a range of motion so that all of the bone surfaces of the legs are properly vibrated, and the reversal of osteoporosis is effected in all of the bones of the legs.

Although FIGS. 3, 4 and 5 depict a single circuit for providing a feedback from the legs of the subject to control the amplitude of the driving vibrations generated by the vibrator, it should be understood that other equivalent circuits may be employed by those having skill in the art without departing from the scope of the invention. Similarly, the components of the circuits depicted in FIGS. 3, 4 and 5 may be changed without changing the function and operation of the circuits. Examples of typical components used in these circuits are set forth in the following table:

TABLE I

| Reference No. | Component | Part No. |
|---|---|---|
| 92 | Accelerometer | 7264–2000 |
| 94 | Op. amp. | 1458 |
| 96 | Op. amp. | 1458 |
| 98 | Op. amp. | 1458 |
| 108 | Op. amp. | 1458 |
| 114 | Transistor | 2N3904 |
| 118 | Transistor | 2N3904 |
| 120 | Timer | NE555 |
| 124 | Op. amp. | 1458 |

While the form of apparatus herein described constitutes a preferred embodiment of the invention, it is to be understood that the invention is not limited to this precise form of apparatus, and that changes may be made therein without departing from the scope of the invention.

What is claimed is:

1. A therapeutic device for reversing osteoporosis in human limbs comprising:

means for supporting at least one human limb;

means for actuating said supporting means to move a supported limb repeatedly along a predetermined path;

means for generating driving vibrations for vibrating said supporting means, whereby said driving vibrations are transmitted from said supporting means to a supported limb; and means for sensing an amplitude of vibrations felt by bones of a supported limb at said supported limb and regulating an amplitude of said driving vibrations in response thereto, thereby maintaining said amplitude of said felt vibrations within a predetermined range as a supported limb is moved along said path.

2. The device of claim 1 wherein said sensing means includes an accelerometer adapted to be mounted on a limb attached to said supporting means, said accelerometer including means for generating a signal proportional in strength to acceleration exerted thereon; and control means, connected to said accelerometer and said vibrating means, for receiving said signal from said accelerometer and generating power for driving said vibrating means which varies in magnitude proportionally to said signal strength.

3. The device of claim 2 wherein said signal is a voltage signal and said control means includes means for modifying said signal such that said signal is reduced to zero volts at a predetermined maximum acceleration sensed by said accelerometer, and is amplified to a predetermined maximum at a zero acceleration sensed by said accelerometer.

4. The device of claim 3 wherein said control means includes means for generating electric current at a predetermined frequency for driving said vibrating means; and means for regulating a voltage amplitude of said current such that said amplitude varies directly with a voltage level of said modified voltage signal, whereby said driving vibrations generated by said vibrating means vary in intensity directly proportionately to said modified voltage signal.

5. The device of claim 2 wherein said supporting means comprises a frame, crank means rotatably mounted on said frame, means attached to said crank means for securing distal ends of a pair of human limbs thereto, and said actuating means is drivingly connected to rotate said crank means, thereby moving said limbs along said path.

6. The device of claim 5 wherein said crank means further comprises a driven sprocket; and said actuating means includes a drive sprocket, motor means for rotating said drive sprocket, and an endless sprocket chain extending about said sprockets.

7. The device of claim 6 wherein said frame comprises a flat base, bracket means attached to said base for mounting said vibrating means thereon, means extending upwardly from said base for attaching said driven sprocket to said base for displacement relative thereto, and means for attaching said drive sprocket and motor means to said base independently of said driven sprocket.

8. The device of claim 7 wherein said upwardly extending means comprises a pair of tubes attached to and extending upwardly from said bracket means; a pair of rods slidably telescoping within said tubes; and a bar joining said rods and attached to said crank means.

9. A therapeutic device for reversing osteoporosis in human limbs, comprising:

crank means for supporting a pair of human limbs at distal ends thereof for cyclical, substantially continuous movement along a predetermined path;

motor means for actuating said crank means to move supported limbs along said path at a predetermined speed;

means for vibrating said supporting means, whereby vibrations are transmitted from said supporting means to supported limbs as said crank means moves supported limbs along said predetermined path; and control means for detecting a vibration amplitude of supported limbs and generating power for driving said vibrating means to generate vibrations of an amplitude proportional to said limb vibration amplitude, such that said limb vibration amplitude is substantially maintained at a predetermined level.

10. A method of treating osteoporosis in bones of human limbs comprising the steps of:

(a) moving said limbs along a predetermined path;

(b) generating driving vibrations of a predetermined amplitude and frequency and transmitting said driving vibrations to said bones substantially simultaneously with step (a);

(c) subsequent to initation of steps (a) and (b), sensing an amplitude of said vibrations felt by said bones at a predetermined location on at least one of said limbs; and (d) subsequent to initation of step (c), modifying said predetermined amplitude of said driving vibrations in response to said sensed amplitude such that said amplitude of said felt vibrations is maintained within a predetermined range.

11. The method of claim 10 wherein said generating step includes generating driving vibrations having a frequency of between 10 hz and 40 hz.

12. The method of claim 11 wherein said modifying step includes modifying said driving vibration amplitude to maintain said vibration amplitude sensed at said location between 10 g and 50 g.

13. The method of claim 10 wherein said pedetermined location is adjacent to an ankle bone of one of said limbs.

* * * * *